US005197829A

United States Patent [19]

Krings

[11] Patent Number: 5,197,829

[45] Date of Patent: Mar. 30, 1993

[54] SUPPORT DEVICE FOR LINING DITCHES

[75] Inventor: Josef Krings, Heinsberg, Fed. Rep. of Germany

[73] Assignee: Teska Verbautechnik GmbH, Oberhausen, Fed. Rep. of Germany

[21] Appl. No.: 843,395

[22] Filed: Feb. 28, 1992

[30] Foreign Application Priority Data

Mar. 2, 1991 [DE] Fed. Rep. of Germany ..... 4106698
Dec. 11, 1991 [DE] Fed. Rep. of Germany ..... 4140815

[51] Int. Cl.[5] ..... E02D 17/08
[52] U.S. Cl. ..... 405/282; 405/272
[58] Field of Search ..... 405/258, 272, 276, 281, 405/282, 283, 285

[56] References Cited

U.S. PATENT DOCUMENTS 3,910,054 10/1975 Krings ..... 405/282
4,421,440 12/1983 Scheepers ..... 405/282

FOREIGN PATENT DOCUMENTS 3820625 1/1989 Fed. Rep. of Germany ..... 405/282
2558499 7/1985 France ..... 405/282

*Primary Examiner*—David H. Corbin
*Attorney, Agent, or Firm*—Collard & Roe

[57] ABSTRACT

A support device for lining ditches having braces for extending across the ditch and vertically extending guiding uprights which are supported by the braces. The guiding uprights include a U-shaped rail with leg members and parallel guide ridges extending in vertical direction located on each of the leg members on the inner portion of the U-shaped rail. Lining plates are provided with vertically-extending end faces, including a plurality of axles with guide rollers rotatably mounted thereon. The axles project outwardly from the end faces, and are alternately displaced on either side of a vertically extending line disposed along the center of the end faces. The lining plates are guided by alternating contact of the guide rollers with the parallel guide ridges of each of the leg members.

7 Claims, 2 Drawing Sheets

Fig. 4
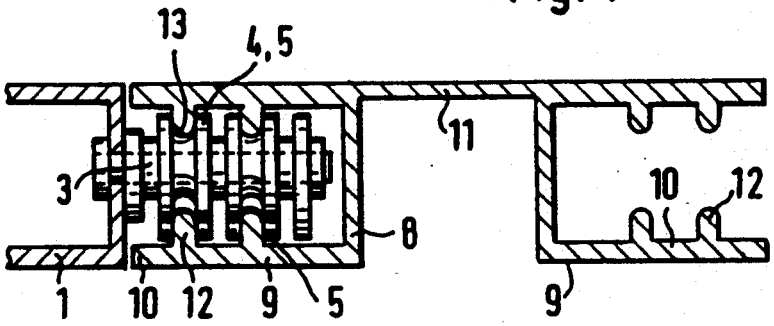
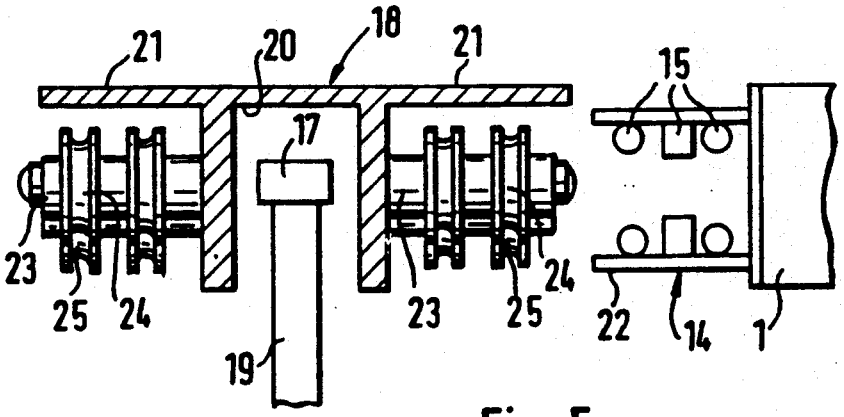
Fig. 5
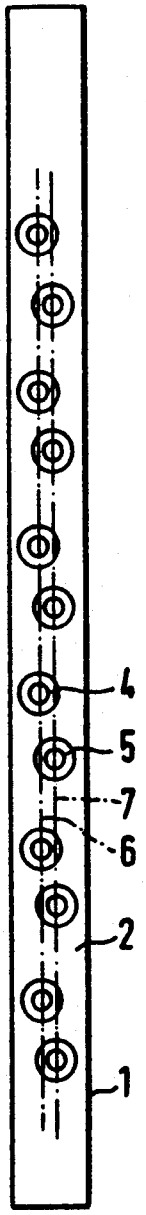
Fig. 3

SUPPORT DEVICE FOR LINING DITCHES

BACKGROUND OF THE INVENTION

1. Field of the Invention

The present invention relates to a support device for lining ditches. More particularly, it relates to such a support device having lining uprights which are held in place at a parallel spaced apart distance by braces and lining plates guided in or on the uprights by means of guide rollers.

2. The Prior Art

A support device is disclosed in German Patent No. 23 23 321 B2, where guide heads with guide rollers are provided at intervals along the height of the end faces of the lining plates. Some of the rollers are mounted with their bearing axes perpendicular to the plane of the lining plate. Other rollers have their axes in a plane between the lateral faces of the lining plate and perpendicular to the guiding uprights. The latter rollers run only along the leg of the section that is toward the inside of the ditch.

The purpose of this prior art patent is to allow the lining plates to move in the guiding uprights with minimal friction. However, it has been found that in practice this construction is not strong enough. An additional guide means with rigid flanges disposed transversely to the plane of the lining plate must also be provided. This is particularly necessary, because the guide rollers must necessarily roll with a great deal of play, and therefore the connection between the guiding uprights and lining plate is unstable. This is particularly the case when compact earth is present which does not directly pres against the lining device.

A ditch lining device is also disclosed in British Patent No. 2,172,029 which includes guide rollers on the end walls of the lining plates. However, these rollers roll exclusively on bearing axes which are perpendicular to the plane of the lining plate. The lining plate is guided against the pressure of the ditch wall in a form-interlocking configuration by means of rigid elements in the guiding uprights.

SUMMARY OF THE INVENTION

It is an object of the present invention to provide a support device for lining ditches which overcomes the drawbacks of the prior art and which has a low-friction rolling configuration employing guide rollers.

It is a further object of the present invention to provide such a device, which insures a stable connection between the lining plate and the guiding uprights exclusively, by means of guide rollers and their associated guide elements.

These and other related objects are achieved by a support device for lining ditches according to the invention. The device includes braces for extending across the ditch and vertically extending guiding uprights which are supported by the braces. The guiding uprights include a U-shaped rail with leg members and two parallel guide ridges extending in the vertical direction located on each of the leg members on the inner portion of the U-shaped rail. Lining plates are provided with vertically extending end faces, including a plurality of axles with guide rollers rotatably mounted thereon. The axles project outwardly from the end faces and are alternately displaced on either side of a vertically extending line disposed along the center of the end faces. The lining plates are guided by alternating contact of the guide rollers with the parallel guide ridges of each of the leg members. The guide rollers have a guide groove with a semicircular cross-section, and the guide ridges have a complementary semicircular cross-sectional shape for guiding the guide rollers. The axles are longer than the diameter of the guide rollers, which is, in turn, shorter than the thickness of the lining plates.

In an alternate embodiment of the invention, the support device for lining ditches has braces for extending across the ditch and vertically extending guiding uprights which are supported by the braces. The guiding uprights include vertically extending end faces and a plurality of axles with guide rollers rotatably mounted thereon. The axles project outwardly from the end faces and are alternately displaced on either side of a vertically extending line disposed along the center of the end faces. Lining plates are provided which include a U-shaped rail with leg members and two parallel guide ridges extending in the vertical direction located on each of the leg members on the inner portion of the U-shaped rail. The lining plates are guided by alternating contact of the guide rollers with the parallel guide ridges of each of the leg members.

The guide rollers have a guide groove with a semicircular cross-section. The guide ridges have a complementary semicircular cross-sectional shape for guiding the guide rollers. The guiding uprights include a vertically extending leg member disposed perpendicular to the end face and adjacent to the ditch wall. The axles are longer than the diameter of the guide rollers, which is, in turn, shorter than the thickness of the lining plates.

BRIEF DESCRIPTION OF THE DRAWINGS

Other objects and features of the present invention will become apparent from the following detailed description considered in connection with the accompanying drawing which discloses two embodiments of the present invention. It should be understood, however, that the drawing is designed for the purpose of illustration only and not as a definition of the limits of the invention.

In the drawing, wherein similar reference characters denote similar elements throughout the several views:

FIG. 3 is a left side view of the lining plate of FIG. 1;

FIG. 4 is an enlarged cross sectional view through a connection between the guiding uprights and lining plate; and FIG. 5 is an enlarged cross sectional view through another embodiment of the connecting arrangement between the guiding uprights and the lining plate.

DETAILED DESCRIPTION OF PREFERRED EMBODIMENTS

Figure 1:
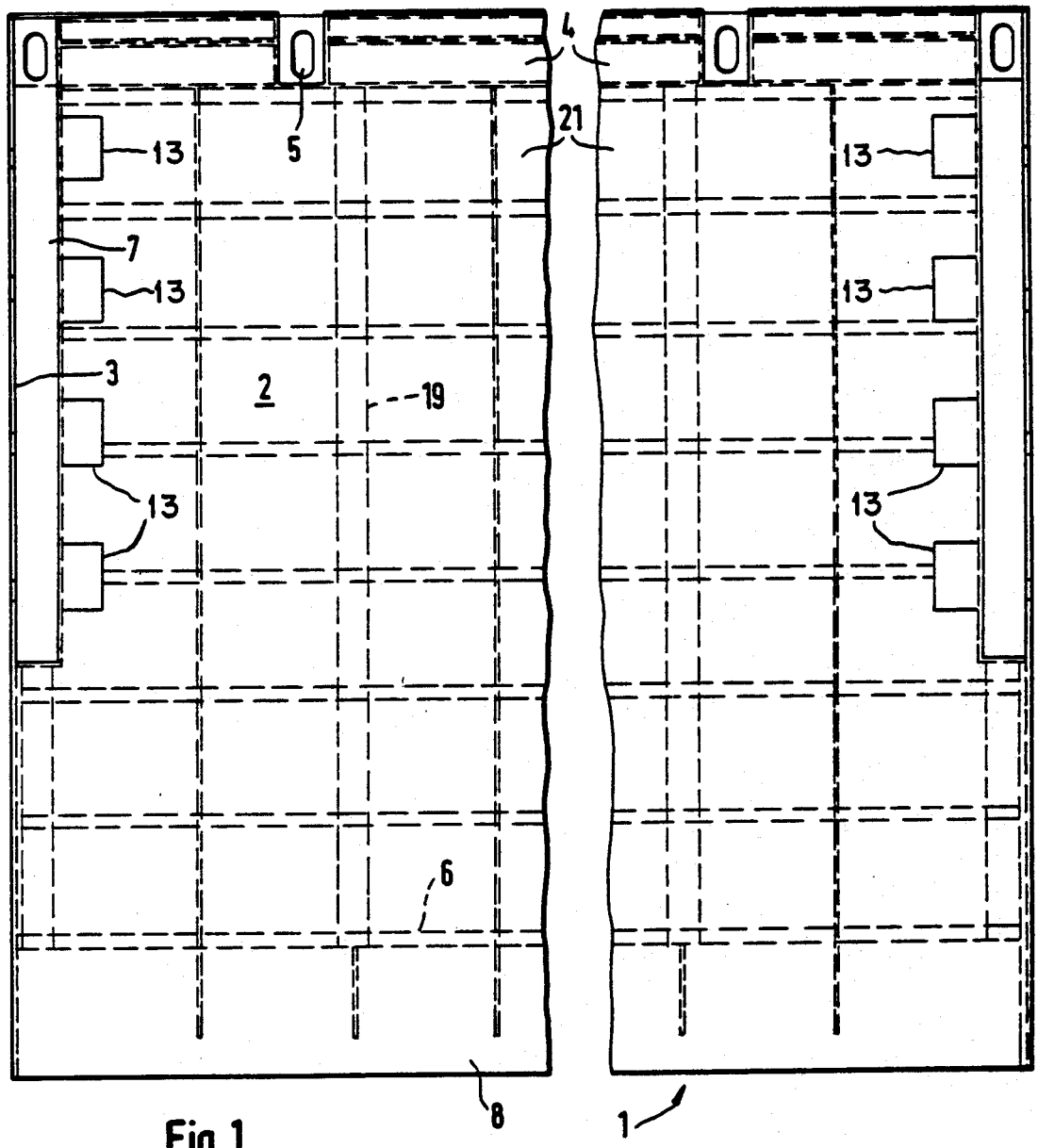
FIG. 1 is a side elevational view of a lining plate element according to the invention.

Turning now in detail to the drawings and, in particular, FIG. 1–4, there is shown a lining plate 1 of a support device for lining ditches. Such a device generally has two parallel rows of lining plates 1 and guiding uprights 8 which hold plates 1 in place. Braces 19 are inserted between lining plates 1 or guiding uprights 8. Braces 19 maintain the separation between the two rows of lining plates 1 which are supported against and which rest against the opposite walls of the ditch.

Lining plate 1 generally has a hollow body surrounded by flat metal plates and, possibly, sectional steel parts. Plates of this type are generally known in the art.

On the narrow end face 2 of lining plate 1, there are plurality of projections or axles 3 disposed one above the other, which support guide rollers 4 and 5.

As. FIG. 3 shows, axles 3 are staggered, so that two connecting lines 6 and 7 shown in phantom, pass respectively through guide rollers 4 and 5.

Figure 2:
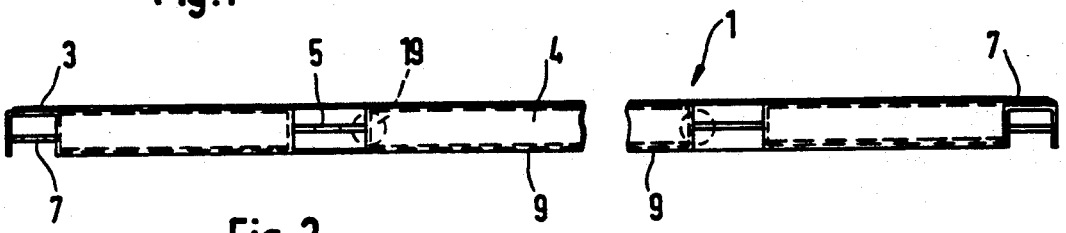
FIG. 2 is a top plan view of the lining plate of FIG. 1.

FIG. 4 shows a connection between guiding upright 8 and a part of lining plate 1 according to FIGS. 1-3. Guiding upright 8 has two U-shaped sections 9. The legs of two U's face in opposite directions. Another U-shaped section 11 is formed between the two U-shaped sections 9. The bases of two U-shaped sections 9 form the legs of the U-shaped section 11. The base of U-shaped section 11 is adjacent to the wall of the ditch. The legs of U-shaped section 11 are perpendicular to the legs of the two U-shaped sections 9.

U-shaped section 11 serves to accommodate a brace (not illustrated), which is oriented transverse to the longitudinal direction of the ditch and rests against a second guiding upright (also not illustrated).

U-shaped sections 9 have parallel guide ridges 12 on the inner sides of their leg members. These ridges may be formed from, e.g. rounded section rods which are welded onto U-shaped section 9.

As FIG. 4 shows, guide rollers 4 and 5 have a guide groove 13 which is approximately semicircular in cross section and which appropriately matches the cross section of guide ridges 12. Advantageously, each axle 3 has at least two guide rollers 4 and 5, with alternate sets of rollers interlockingly engaging guide ridges 12. Guide rollers 4 rest against guide ridges 12 of one leg 10 of U-shaped section 9. Guide rollers 5 rest against guide ridges 12 of the other leg of U-shaped section 9. Advantageously, axle 3 is longer than the diameter rollers 4 and 5. The diameter of guide rollers 4 and 5 is advantageously shorter than the thickness of lining plate 1. In this manner, play between lining plate 1 and guiding uprights 8, which would give rise to undesirable and hazardous forces is avoided. The relatively large contact surface provided by the plurality of guide rollers 4 and 5 provides this connection with excellent stability.

FIG. 5 shows a second embodiment where the axles and rollers are mounted on guiding upright 18. In this case, lining plates 1 have a U-shaped guide head 14. The base of U-shaped guide head 14 is end face 2 of lining plate 1.

Leg members 22 of guide head 14 have parallel guide ridges 15 on their interior sides. Guiding uprights 18 have a U-shaped section 20 for accommodating the abutting shoe 17 of a brace 19 (shown only schematically).

The base of U-shaped section 20 is extended past its leg members on both sides. Extensions 21 form a shield which prevents soil from penetrating axles 23, which are mounted on the leg members of U-shaped section 20. Guide rollers 24, 25 are mounted on axles 23 in two close parallel rows as is the case in FIG. 4. Rollers 24 and 25 alternately lie against one or the other leg member of guide head 14. Guide head 14 of lining plate 1 is interlockingly engaged with guide rollers 24, 25 of the guiding upright. Axle 23 is preferably longer than the diameter of guide rollers 24 and 25. The diameter of guide rollers 4 and 5 is preferably shorter than the thickness of plate 1. In this manner, play between plate 1 and guiding uprights 18, which would give rise to undesirable and hazardous forces is avoided. The relatively large contact surface provided by the plurality of parallel guide ridges 15, provides this connection with excellent stability.

Cylindrical guide rollers may be provided instead of guide rollers 4 and 5. In this case the guide ridges engage the space intermediate between two neighboring rolling guide rollers, with the rollers rolling directly on leg 10 of the associated U-shaped section (not shown).

While several embodiments of the present invention have been shown and described, it is to be understood that many changes and modifications may be made thereunto without departing from the spirit and scope of the invention as defined in the appended claims.

What is claimed is:

1. A support device for lining ditches, comprising:

braces for extending across the ditch;

vertically extending guiding uprights which are supported by said braces and include a U-shaped rail with leg members, and two parallel guide ridges extending in the vertical direction located on each of said leg members on the inner portion of said U-shaped rail; and lining plates with vertically extending end faces, including a plurality of axles with guide rollers rotatably mounted thereon, said axles projecting outwardly from said end faces and being alternately displaced on either side of a vertically extending line disposed along the center of said end faces, wherein said lining plates are guided by alternating contact of said guide rollers with said parallel guide ridges of each of said leg members.

2. The support device according to claim 1, wherein said guide rollers have a guide groove with a semicircular cross-section; and wherein said guide ridges have a complementary semicircular cross-sectional shape for guiding said guide rollers.

3. The ditch lining device according to claim 2, wherein said axles are longer than the diameter of said guide rollers, and the diameter of said guide rollers is shorter than the thickness of said lining plates.

4. A support device for lining ditches, comprising:

braces for extending across the ditch;

vertically extending guiding uprights which are supported by said braces and include vertically extending end faces and a plurality of axles with guide rollers rotatably mounted thereon, said axles projecting outwardly from said end faces and being alternately displaced on either side of a vertically extending line disposed along the center of said end faces; and lining plates including a U-shaped rail with leg members and two parallel guide ridges extending in the vertical direction located on each of said leg members on the inner portion of said U-shaped rail, wherein said lining plates are guided by alternating contact of said guide rollers with said parallel guide ridges of each of said leg members.

5. The support device according to claim 4, wherein said guide rollers have a guide groove with a semicircular cross-section; and wherein said guide ridges have a complementary semicircular cross-sectional shape for guiding said guide rollers.

6. The ditch lining device according to claim 5, wherein said guiding uprights include a vertically extending leg member disposed perpendicular to said end faces adjacent to the ditch wall.

7. The ditch lining device according to claim 6, wherein said axles are longer than the diameter of said guide rollers, and the diameter of said guide rollers is shorter than the thickness of said lining plates.

* * * * *